US005232525A

United States Patent [19]

Smith et al.

[11] Patent Number: 5,232,525

[45] Date of Patent: Aug. 3, 1993

[54] POST-CONSOLIDATION METHOD FOR INCREASING THE FRACTURE RESISTANCE OF TITANIUM COMPOSITES

[75] Inventors: Paul R. Smith, Springboro; Daniel Eylon, Dayton, both of Ohio

[73] Assignee: The United States of America as represented by the Secretary of the Air Force, Washington, D.C.

[21] Appl. No.: 867,725

[22] Filed: Mar. 23, 1992

[51] Int. Cl.[5] ..... C22C 14/00

[52] U.S. Cl. ..... 148/514; 148/669; 148/670; 428/614; 428/660

[58] Field of Search ..... 148/514, 669, 670; 428/614, 660

[56] References Cited

U.S. PATENT DOCUMENTS

| | | | |
|---|---|---|---|
| 4,675,964 | 6/1987 | Allison | 148/670 |
| 4,816,347 | 3/1989 | Rosenthal et al. | 428/614 |
| 4,975,125 | 12/1990 | Chakrabarti et al. | 148/669 |
| 5,026,520 | 6/1991 | Bhowal et al. | 148/670 |
| 5,074,907 | 12/1991 | Amato et al. | 148/514 |
| 5,125,986 | 6/1992 | Kimura et al. | 148/670 |

*Primary Examiner*—Upendra Roy

*Attorney, Agent, or Firm*—Charles E. Bricker; Donald J. Singer

[57] ABSTRACT

A method to increase the fracture resistance of titanium alloy matrix composites which comprises thermally treating a composite at a temperature about 5 to 10% above the beta-transus temperature of the alloy for about 4 to 60 minutes.

6 Claims, 1 Drawing Sheet

POST-CONSOLIDATION METHOD FOR INCREASING THE FRACTURE RESISTANCE OF TITANIUM COMPOSITES

RIGHTS OF THE GOVERNMENT

The invention described herein may be manufactured and used by or for the Government of the United States for all governmental purposes without the payment of any royalty.

BACKGROUND OF THE INVENTION

This invention relates to titanium alloy/fiber composite materials. In particular, this invention relates to a method for improving the fracture resistance of such composite materials.

Composites are recognized as a material class capable of operating under conditions requiring very high specific stiffness and strength. Synthetic matrix composites are generally limited to maximum operating temperatures of about 200° C. Metal matrix composites are capable of higher operating temperatures. Aluminum- and titanium-based composites comprise the majority of metal matrix composites employed, particularly in aerospace applications. Aluminum-based composites are currently limited in application to about 800° F., due to their degraded matrix strength at higher temperatures. Titanium-based composites are currently considered for many advanced aerospace applications in the temperature range of 800°-1800° F. due to improved matrix creep and environmental resistance.

Continuously reinforced conventional titanium matrices, e.g., Ti-6Al-4V and Ti-15V-3Al-3Cr-3Sn, have been the subject of numerous investigations. Metal matrix composites of these alloys have found limited applications in the temperature range of 800°-1200° F. Significant applications are under consideration for composites utilizing the ordered intermetallic matrices based on the $Ti_3Al$ compound. This class of materials has greatly improved oxidation resistance as well as high temperature strength retention and is being considered for applications up to 1800° F. In both classes of titanium composites, the fatigue properties in the direction of the reinforcement are reasonably good and represent improvements over the unreinforced materials. However, off-axis fracture properties are significantly reduced when compared to the monolithic (non-reinforced) alloys due to the poor load transfer at the interface, thereby limiting their application where isotropic properties are required. The composite fatigue properties have been shown to be controlled by matrix failure relatively early in life. It is assumed that these complex systems contain small defects in their as-fabricated condition. Such defects include reaction zone microcracks, reaction zone and matrix voids, matrix disbonds and cracked fibers. The fatigue life of the composite is then dictated by the time/load necessary to cause these flaws to propagate to a critical size wherein the composite fails. If the time/load required to reach this critical size is increased, the service life of the composite is similarly increased, particularly in applications requiring off-axis orientation loading.

Accordingly, it is an object of this invention to provide a method to increase the fracture resistance of titanium alloy matrix composites.

Other objects and advantages of the invention will be apparent to those skilled in the art.

SUMMARY OF THE INVENTION

In accordance with the present invention, there is provided a method to increase the fracture resistance of titanium alloy matrix composites which comprises the steps of consolidating a titanium alloy-fiber preform under suitable conditions to provide a metal matrix composite and thermally treating the thus-prepared composite.

In one aspect of the present invention, the titanium alloy is a conventional alloy, in which case the phrase "suitable conditions" is intended to mean heating the alloy-fiber preform to a temperature below the beta-transus temperature ($T_\beta$) of the alloy while applying a pressure of at least 10 Ksi for a time sufficient to effect consolidation. In this case, the term "beta-transus" refers to the temperature at the line on the phase diagram for the alloy separating the $\beta$-phase field from the $\alpha$-$\beta$ region where the $\alpha$ and $\beta$ phases coexist.

In another aspect of the present invention, the titanium alloy is an alpha-2 titanium aluminide alloy ($\alpha_2$) or an orthorhombic titanium aluminide alloy (o), in which case the phrase "suitable conditions" is intended to mean heating the alloy-fiber preform to a temperature below the beta-transus temperature ($T_\beta$) of the alloy while applying a pressure of at least 10 Ksi for a time sufficient to effect consolidation. In the case of the alpha-2 alloy, the term "beta-transus" refers to the temperature at the line on the phase diagram for the alloy separating the $\beta$-phase field from the $\alpha_2$-$\beta$ region where the $\alpha_2$ and $\beta$ phases coexist. In the case of the orthorhombic alloy, the term "beta-transus" refers to the temperature at the line on the phase diagram for the alloy separating the $\beta$-phase field from the $\beta_2$+o (+$\alpha_2$) region where the $\beta_2$ and o, and possibly the $\alpha_2$, phases coexist.

DETAILED DESCRIPTION OF THE INVENTION

Figure 1:
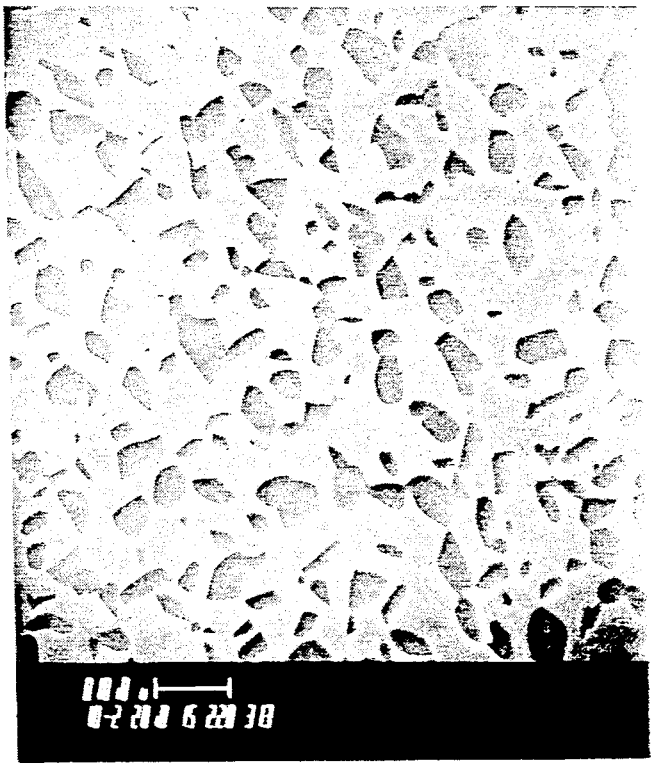
FIG. 1 is a 100× microphotograph of an Al-Nb alpha-2 titanium aluminide alloy/fiber compact following consolidation.

Thermal treatment of the prepared composite is accomplished by heating the composite to a temperature about 5 to 10% above $T_\beta$ (in degrees C.) for a time about 4 to 25% of the consolidation time, generally about 4 to 60 minutes. The thermal treatment is a post-consolidation treatment, i.e., it is carried out after the composite is cooled and removed from the consolidating apparatus. In general, the consolidation system, i.e., the press or autoclave or the like, including the composite structure, has a large thermal mass. It is therefore inconvenient, if not impractical, to rapidly change the temperature of such mass. Thus, for the thermal treatment, other heating means, such as induction heating, resistance heating, heating using a hot gas stream, or the like, may be used. These heating means will allow for localized heating, thus it is possible to heat treat selected areas requiring improved fracture resistance and improved creep resistance. If it is desired to heat treat the entire composite structure, such heating means can be moved from area to area, either continuously or in stepwise fashion.

The matrix microstructure of the consolidated conventional alloy composite is a very fine equiaxed alpha structure, the result of the large amount of alpha+beta deformation during compaction, i.e., superplastic forming/diffusion bonding, as well as the compaction thermal cycle which is carried out in the alpha+beta phase field. Similarly, the matrix microstructure of the consolidated alpha-2 titanium aluminide composite is a very fine equiaxed alpha-2+beta structure. The matrix microstructure of the consolidated orthorhombic titanium aluminide composite is a very fine equiaxed beta-two plus orthorhombic plus possibly alpha-2 structure. Heat treatment of these very fine equiaxed structures produces a higher aspect ratio grain structure having increased fatigue crack propagation resistance without significantly increasing the thickness of the fiber/matrix reaction zone.

The alloys suitable for use in the present invention are the alpha+beta titanium alloys, the alpha-2 titanium alloys and the orthorhombic titanium alloys. The term "alpha+beta" means an alloy of titanium which is characterized by the presence of significant amounts of alpha phase and some beta phase. Thus, the use of the so-called "alpha-beta" alloys, such as Ti-6Al-4V, as well as the so-called "beta" alloys, such as Ti-15V-3Cr-3Al-3Sn or Ti-10V-2Fe-3Al, constitute part of the invention. Other suitable alpha+beta alloys include, for example, Ti-6Al-6V-2Sn, Ti-8Mn, Ti-7Al-4Mo, Ti-4.5Al-5Mo-1.5Cr, Ti-6Al-2Sn-4Zr-6Mo, Ti-5Al-2Sn-2Zr-4Mo-4Cr, Ti-6Al-2Sn-2Zr-2Mo-2Cr, Ti-5.5Al-3.5Sn-3Zr-0.3Mo-1Nb-0.3Si, Ti-5.5Al-4Sn-4Zr-0.3Mo-1Nb-0.5Si-0.06C, Ti-30Mo, Ti-13V-11Cr-3Al, Ti-3Al-3V-6Cr-4Mo-4Zr, Ti-15V, Ti-11.5Mo-6Zr-4.5Sn, Ti-10Mo and Ti-6.3Cr. Suitable alpha-2 titanium alloys include Ti-14Al-21Nb and Ti-14Al-20Nb-3V-2Mo. Orthorhombic alloys contain a higher quantity of beta stabilizer, preferably Nb. Suitable orthorhombic titanium alloys include Ti-13Al-31Nb and Ti-13Al-40Nb.

The titanium composites are fabricated by superplastic forming/diffusion bonding of a sandwich consisting of alternating layers of metal and fibers. At least four high strength/high stiffness filaments or fibers for reinforcing titanium alloys are commercially available: silicon carbide, silicon carbide-coated boron, boron carbide-coated boron and silicon-coated silicon carbide. Under superplastic conditions, the titanium matrix material can be made to flow without fracture occurring, thus providing intimate contact between layers of the matrix material and the fiber. The thus-contacting layers of matrix material bond together by a phenomenon known as diffusion bonding. Unfortunately, at the same time a reaction occurs at the fiber-matrix interfaces, giving rise to what is called a reaction zone. The intermetallic compounds formed in the reaction zone may include reaction products like TiSi, $Ti_5Si$, TiC, TiB and $TiB_2$. The thickness of this brittle reaction zone is a diffusion controlled reaction and thus increases with increasing time and with increasing temperature of bonding. Such brittle reaction zones introduce sites for easy crack initiation and propagation within the composite, which can operate in addition to existing sites introduced by the original distribution of defects in the filaments and/or the matrix.

The metal layers for fabricating the above-described sandwich are rolled foil having a thickness of 3 to 10 mils, or preferably, rapidly solidified foil having a thickness of about 10 to 100 microns. The layers may also be produced by powder techniques, such as plasma spray, tape casting or powder cloth.

Consolidation of the filament/metal layer preform sandwich is accomplished by application of heat and pressure over a period of time during which the matrix material is superplastically formed around the filaments to completely embed the filaments. Consolidation is carried out at a temperature in the approximate range of 50° to 300° C. (90° to 540° F.) below the beta-transus temperature of the titanium alloy. For example, the consolidation of a composite comprising Ti-6Al-4V alloy, which has a beta transus of about 995° C. (1825° F.) is preferably carried out at about 900° C. to 925° C. (1650° to 1700° F.). The pressure required for consolidation of the composite ranges from about 66 to about 200 MPa (about 10 to 30 Ksi) and the time for consolidation can range from about 15 minutes to 24 hours or more, depending upon the thickness of the composite. Generally, consolidation time is about 2 to 4 hours.

As discussed previously, the composite is heat treated at a temperature about 5 to 10% above $T_\beta$ for about 4 to 25% of the consolidation time. For example, a composite comprising Ti-6Al-4V alloy may be heat treated at a temperature of about 1045° to 1095° C. for about 5 to 60 minutes. This heat treatment will produce a higher aspect ratio grain structure having increased fatigue crack propagation resistance without significantly increasing the fiber/matrix reaction zone. Increased fitigue crack propagation resistance in the matrix provides, in turn, improvement in the overall fracture resistance of the composite, particularly for off-axis loading applications.

Figure 2:
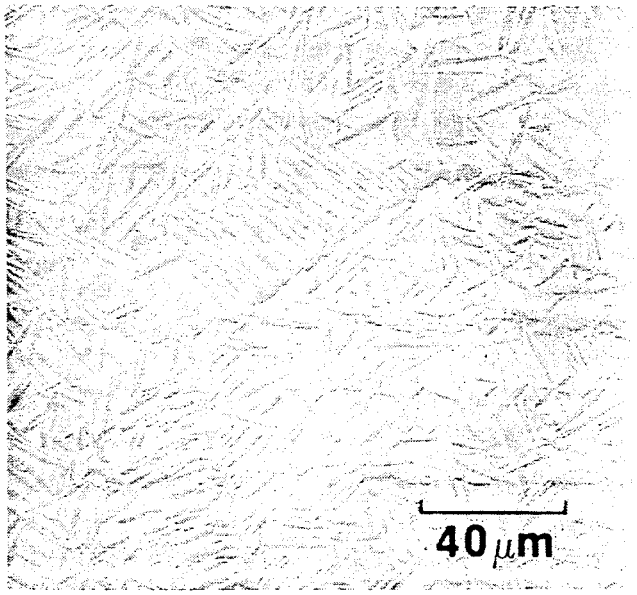
FIG. 2 is a 50× microphotograph of a similar compact following heat treatment at 1260° C. (beta-transus temperature +110° C.) for 10 minutes.

Referring to the drawing, in FIG. 1, it can be seen that the microstructure of the alloy, following consolidation is an equiaxed $\alpha_2+\beta+o$ microstructure. This type of microstructure enables easier consolidation, but has both poor fracture resistance and creep resistance. In FIG. 2, it can be seen that following heat treatment in accordance with the invention, the microstructure is a transformed, i.e., high aspect ratio, $\alpha_2+\beta+o$ microstructure. This microstructure has improved fracture resistance and improved creep resistance.

Various modifications may be made to the invention as described without departing from the spirit of the invention or the scope of the appended claims.

We claim:

1. A method to increase the fracture resistance of titanium alloy matrix composites which comprises heating a composite to a temperature about 5 to 10% above the beta-transus temperature of the alloy for about 4 to 60 minutes.

2. The method of claim 1 wher in said titanium alloy is a conventional titanium alloy.

3. The method of claim 1 wherein said titanium alloy is an alpha-2 titanium aluminide alloy.

4. The method of claim 1 wherein said titanium alloy is an orthorhombic titanium aluminide alloy.

5. The method of claim 1 wherein said heating is applied to at least one discrete area of said composite.

6. The method of claim 1 wherein said heating is applied to the entire composite.

* * * * *